United States Patent [19]

Harris

[11] 4,203,014

[45] May 13, 1980

[54] ADJUSTABLE INTERVAL CYCLE TIMER

[75] Inventor: John L. Harris, Clearwater, Fla.

[73] Assignee: Deltrol Corp., Bellwood, Ill.

[21] Appl. No.: 907,802

[22] Filed: May 19, 1978

[51] Int. Cl.[2] ..... H01H 43/10

[52] U.S. Cl. ..... 200/38 R; 200/38 A; 200/38 BA; 200/39 R

[58] Field of Search ..... 200/35 R, 38 R, 38 A, 200/38 F, 39 R, 39 A, 38 B, 38 BA; 74/3.5, 3.52, 3.54, 3.56, 435, 405, 409

[56] References Cited

U.S. PATENT DOCUMENTS

| | | | |
|---|---|---|---|
| 2,917,939 | 12/1959 | Harris | 200/38 R X |
| 3,700,837 | 10/1972 | Schulze-Berge | 200/38 A X |

*Primary Examiner*—James R. Scott

[57] ABSTRACT

A stop start fixed cycle sequence timer is started at variable intervals by an adjustable automatic reset timer. This reset timer includes a clutch and resets when the clutch is disengaged. The cycling timer includes a clutch cam and cam follower which disengages and reengages the clutch while the cycling timer is going through its cycle.

12 Claims, 5 Drawing Figures

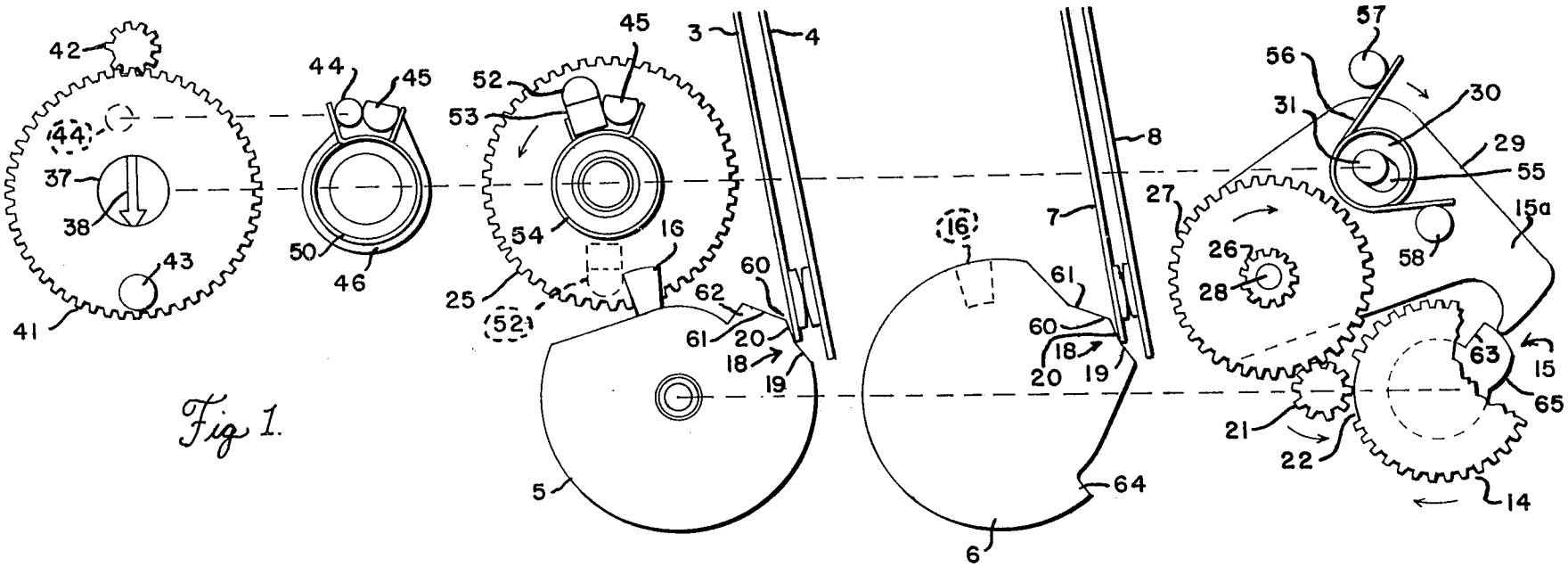
Fig. 1.
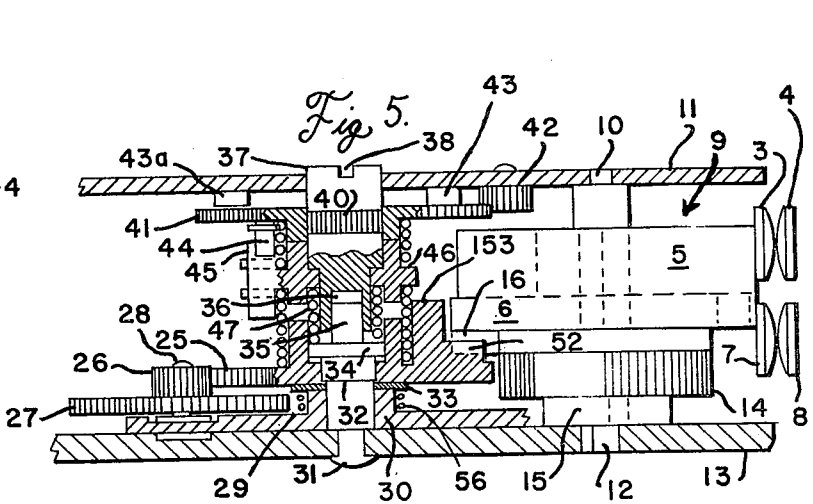
Fig. 5.
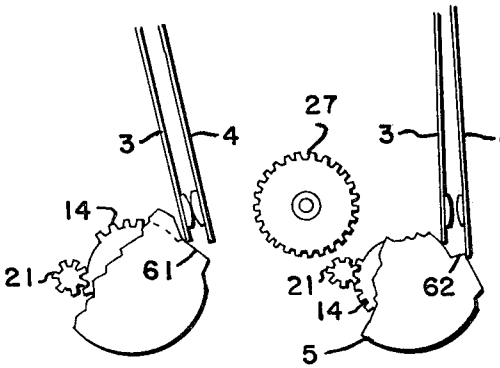
Fig. 4.
Fig. 3.
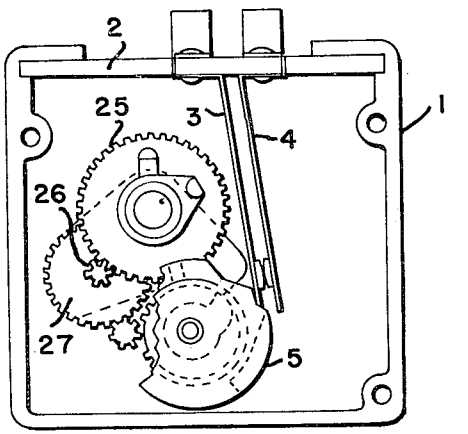
Fig. 2.

ADJUSTABLE INTERVAL CYCLE TIMER

BACKGROUND OF THE INVENTION

In the air conditioning industry, heat pump systems are used for both cooling and heating. When the system is heating, the outside evaporator becomes frosted and requires periodic defrosting. The most popular defrosting system includes a timer operating switches in sequence which puts the system through a fixed defrost cycle at fixed intervals. The frequency of defrosting depends on the location of the system. For example a system operating in a humid location such as Florida requires more frequent defrost cycles than the same system operating in a dry location such as Arizona. In the past it has been the practice of manufacturers to purchase their timers in an assortment of different timings between defrost cycles, and ship units with the proper timings to the different sections of the country. This involves extra inventory, extra costs in manufacturing and shipping, and the ever present danger of shipping the wrong unit to a given section of the country. Prior to applicant's invention it was not economic to provide all units with an identical adjustable timer as the extra cost of the adjustable feature was prohibitive.

BRIEF SUMMARY OF THE INVENTION

The primary object of the present invention is to provide a low cost fixed cycle timer in which the interval between cycles is adjustable over a wide range.

The invention includes two separate timers driven by a single motor. One timer is a stop start cam operated timer similar to that shown in my U.S. Pat. No. 2,917,939 dated Dec. 22, 1959. This timer is driven by a gear having a segment without teeth. It stops when this segment reaches its drive pinion. The timer of the present invention is restarted by a second timer including a spring return reset gear. This reset gear advances the first timer gear causing the teeth to reengage and drive through one revolution. During this revolution, separate cam operated switches are operated in the necessary sequence to control a defrost cycle.

Also, during this cycle a cam on the first timer operates a cam follower releasing the clutch for the reset timer causing it to reset. The clutch consists of a gear carried bodily by the cam follower. Binding of this clutch gear with its drive pinion is avoided by a yieldable bearing for the cam follower. The cycle timer clutch cam is formed to delay reengagement of the clutch until shortly before the end of the defrost cycle. This adds to the timing of the reset timer and reduces the gear reduction required for a given time period between defrost cycles.

The switch cams of the cycle timer are formed to advance the gear into engagement without transfer of the switches. Thus the spring pressure of the switches is utilized for starting the cycle timer.

Provision is made for absorbing the shock of the reset timer on striking its reset stop and for allowing it to be adjusted even when the clutch is engaged. This consists of a stop member mounted in yieldable relationship with the adjusting member that sets the timing of the reset timer.

Other objects of the invention will appear from the following detailed description and appended claims.

BRIEF DESCRIPTION OF DRAWINGS

FIG. 1 is an exploded view of the complete timer showing the relationship of the parts of the two timing mechanisms.

FIG. 2 is a front elevation with the cover and certain parts omitted.

FIG. 3 is a fragmentary view showing the relationship of the switch cams and gears as a cycle as being started by the cycle timer.

FIG. 4 is a view similar to FIG. 3 but showing one switch in its transfered position.

FIG. 5 is a crossection of the complete timer mechanisms shown in FIGS. 1 and 2.

DETAILED DESCRIPTION OF THE INVENTION

The stop-start cycling timer will first be described.

Referring to FIG. 2 reference character 1 indicates a molded timer case of moulded construction carrying a terminal panel 2 which in turn carries switch blades 3 and 4 which extend downwardly to a front switch cam 5. Both switch blades are biased toward the cam, the switch blade 3 always riding the cam. Switch blade 4 is slightly longer than switch blade 3. A second or rear cam 6 may be located behind the cam 5 (FIGS. 1 and 5) and control a second switch including switch blades 7 and 8. The cams 5 and 6 may be of different configuration so that the switch 3–4 is operated at different times from the switch 7–8. As shown in FIG. 5, cams 5 and 6 may be incorporated into a single molded part 9 having a shaft 10 extending into the front plate 11 of the timer and a bearing 12 extending into the back 13 of the molded case 1. The molded part 9 also includes a gear 14 and a clutch cam 15 located between the gear and the back 13 of the timer case. This clutch cam 15 operates a cam follower which is part of the reset timer mechanism which will be described later.

The molded part 9 also includes a starter lug 16. This starter lug is located rearwardly of the rear cam 6 in a space between this rear cam and the gear 14. As will be described this starter lug is engaged by a reset timer mechanism for starting the cycling timer mechanism through a cycle.

Referring to FIG. 1 both cams 5 and 6 are provided with holding notches 18 consisting of downwardly inclined portions 19 and rise portions 20. The gear 14 which drives the cams is driven by a pinion 21 and is formed with a segment 22 in which the teeth have been omitted. FIG. 1 shows the cycling timer parts in standby position ready for a new cycle. It should be noted that the pressure of the switch blades on the notches 18 in both cams holds the gear 14 disengaged from its drive pinion 21. There is no contact causing any wear on the pinion and gear. There is also no possibility of vibration advancing the cams and gear into a false cycle.

The spring return timing mechanism which starts the cycle timer mechanism at selected intervals will now be described.

This reset timer mechanism includes a spring return timing element in the form of a gear 25 meshing with a pinion 26 carried by a clutch gear 27 which is driven by the same pinion 21 that drives the cycle timer mechanism gear 14. The pinion and gear 26–27 are mounted on a stud 28 carried by a clutch lever 29. This clutch lever is preferably molded and is formed with a hub 30 which serves as a bearing supported by a stud 31 attached to the back 13 of the timer housing. This stud 31 also serves as a bearing and retainer for the reset gear 25.

Preferably the stud 31 includes a shoulder 32 between the sections supporting cam follower 29 and reset gear 25. This shoulder serves as a stop for a washer 33 and prevents the cam follower and its spring from binding reset gear 25. Stud 31 also includes a shoulder portion 34 which serves as part of the bearing for the reset gear 25 and also serves to hold this gear in place. Stud 31 also includes a forwardly extending portion 35 which fits into a bore 36 formed in the rear of an adjusting shaft 37. This adjusting shaft extends through the front plate 11 of the timer and is formed with a screwdriver slot 38 having an arrow head an one end. Shaft 37 also includes a knurled portion 40 and receives an adjusting member or setting gear 41 which meshes with a locking pinion 42 carried by the front plate 11 of the timer. The setting gear is formed with a forwardly extending lug 43 which is adapted to engage a rearwardly extending pin **43*a* carried by the front plate. These serve as a stop for limiting rotation of the setting shaft 37. The setting gear 41 also includes a rearwardly extending pin 44 which is engaged by a stop lug 45 forming part of a stop member 46. This stop member 46 is carried by the setting shaft 37 and is pushed forwardly by a compression spring 47 which surrounds a reduced portion of the setting shaft 37 and bears against the shoulder portion 34 of the stud 31. The stop member 46 is urged in a counter-clockwise direction as seen in FIG. 1 by means of a torsion spring 50 which surrounds hubs formed on the setting gear 41 and the stop member 46 (FIG. 5). As shown in FIG. 1 one end of the torsion spring bears against the pin 44 carried by the setting gear and the other end of the torsion spring bears against the stop stud 45**.

The reset gear 25 is formed with a forward extension 52 which extends under the rear cam 6 and is adapted to engage the starting lug 16 of the cycle timer mechanism. The reset gear 25 also includes a lug 53 extending forwardly sufficiently to be engaged with the rearwardly extending portion of the stop lug 45 carried by stop member 46. The reset gear 25 is biased in a clockwise direction by a reset spring 54 which fits over hubs formed both on the reset gear 25 and stop member 46. As shown in FIG. 1 one end of spring 54 engages lug 53 on the reset gear and the other end of the spring engages the lug 45 on the stop member.

As shown in FIG. 1, the clutch gear 27 is bodily carried by the clutch lever 29 which is actually a cam follower. This cam follower is pivotally supported by the stud 31 and includes a portion **15*a* which follows the cam 15 forming part of the cycle timer mechanism. The bearing hole for the cam follower is formed as an elongated slot 55 in the hub 30. Surrounding the hub 30 is a torsion spring 56 having one leg bearing on a stud 57 carried by the back 13 of the timer housing. The other leg of the torsion spring bears against a lug 58 formed on the cam follower 16. This spring serves to bias the cam follower in a counter-clockwise direction as seen in FIG. 1 causing it to bear on the cam 15. This same torsion spring also urges the entire cam follower downwardly and to the right causing one end of the slotted bearing hole 55 to press against the stud 31**.

OPERATION

With the parts in the positions shown in FIG. 1 the cycling timer mechanism is in standby position. Both switches are closed and bear on the bottom of the holding notches 18 in their respective cams. The gear 14 on the cycle timer mechanism is disengaged from pinion 22 and the top of cam 15 is under the cam follower 16 causing the clutch gear 27 to be engaged with drive pinion 21. The reset timer mechanism is thus in operation which causes the reset gear 25 to be driven counter-clockwise which will cause lug 53 on this gear to separate from the reset stop lug 45 carried by the stop member 46. Eventually the gear will rotate to the position where lug 52 is shown in dotted lines. At this point lug 52 is engaging starting lug 16 and begins to drive the cycle timer mechanism in a clockwise direction as seen in FIG. 1. The rise portions 20 of holding notches 18 in cams 5 and 6 lift both switches until the top portions 60 of each cam reach the ends of the switch blades 3 and 7. At this time switch blades 3 and 7 start riding down the slopes 61 of each cam. The spring pressure of the switch blades now drives the entire cam assembly clockwise causing the first tooth of the gear 14 to engage drive pinion 21. As shown in FIG. 3, the sloping portions 61 of the cams are arranged so that the switches do not transfer during this portion of the cycle where gear 14 is being pushed into engagement with its pinion 21.

After the gears are fully engaged as shown in FIG. 4, the switch blade 3 rides off the abrupt dropoff 62 on cam 5. At this time, due to switch blade 4 being slightly longer than switch blade 3, the contacts separate as shown. As cam 5 continues to rotate the switch blade 4 drops off section 62 and the contacts reengage.

Also after the gear 14 is fully engaged with the pinion 21 the cam follower 16 drops off the abrupt drop-off section 63 on cam 15 and the cam follower is rotated by spring 56 to disengage the clutch gear 27 from the pinion 21. At this time, the reset spring 54 drives the reset gear 25 in a clockwise direction until lug 53 on the gear strikes the stop lug 45 of stop member 46. The impact of lug 53 striking the stop lug 45 is absorbed by yielding of the spring 50, this preventing undue strain on the parts.

Preferably cam 15 is proportioned to keep the clutch gear 27 engaged with pinion 21 until gear 14 is also meshing with pinion 21. This insures a complete cycle by the cycle timer mechanism even if binding occurs. The purpose of the points 60 and slopes 61 on the cams is to provide a definite starting point for the cycle timer for improving timer accuracy.

As the cycle timer mechanism continues to rotate clockwise through its cycle the drop-off section 64 of rear cam 6 comes under switch blades 7 and 8 causing the contacts to close and reopen a short time later. As the end of the cycle approaches, the section 65 of the clutch cam starts rotating the cam follower 29 counter-clockwise bringing the clutch 27 into engagement with pinion 21. At this time, if the top of a tooth on the gear 27 engages the top of a tooth on the pinion 21, movement of the gear will temporarily stop. The cam follower will now pivot about its stud 28 as a center, this movement being allowed by the slotted bearing 55 and yielding of the torsion spring 56. When the pinion 21 moves sufficiently so that its tooth clears the interfering tooth on the gear 27, the gears will engage without further interference.

At the end of the cycle for the cycle timer mechanism the top of clutch cam 15 is under the cam follower 16 and switch blades 3 and 7 ride down into holding notches 18 of their respective cams, causing the parts to reassume a positions shown in FIG. 1.

In order to adjust the length of time between cycles of the cycling timer mechanism, the user sets the reset timer. This is done by inserting a screwdriver in the screwdriver slot 38 on shaft 37. The user then pushes the shaft 37 inwardly which movement is allowed by the compression spring 47. This inward movement of the shaft 37 disengages the adjusting member or setting gear 41 from the locking pinion 42 which allows the shaft 37 to be moved to the desired time setting. It will be understood that suitable indicia is provided on the timer front plate 11 and that the arrowhead portion of the screwdriver slot 38 indicates the timing on this indicia. Rotation of the setting shaft 37 changes the angular position of the stop lug 45 which in turn controls the starting position of lug 52–53 of the reset gear. The further the setting gear is turned clockwise, the longer the timing.

Another function of stop member spring 50 is to permit adjustment of setting shaft 37 in a direction for reducing the timing of the reset timer even when the clutch is engaged. It will be noted when the clutch means is engaged, the reset gear 25 is locked to the timer motor (not shown). At this time the gear cannot be moved manually. In adjusting in a counter-clockwise direction after stop lug 45 engages lug 53 on the reset gear, the lug 45 remains stationary. However setting shaft 37 can continue to be turned as pin 44 on the gear 41 can separate from lug 45 of the stop member, this being permitted by yielding of spring 50. The spring 50 thus has the dual function of absorbing reset impact and permitting time adjustment at any time.

It should be noted that the clutch cam is proportioned so that the clutch is not reengaged until shortly before the end of the timing of the cycle timing mechanism. During this time the clutch is disengaged and the reset gear remains stationary with lug 53 engaging stop lug 45. Thus until the clutch 21–27 is engaged, the reset timer mechanism remains stationary. Thus the total timing between cycle starts of the cycle timer mechanism is the sum of the reset timer timing and a substantial portion of the cycle timer timing. This addition of the cycle timer timing to that of the reset timing reduces the gear reduction required for a given maximum timing.

From the foregoing it will be apparent that applicant's invention provides a simple and inexpensive cycle timer mechanism in which the timing between cycles is adjustable.

It will be apparent that many modifications may be made without departing from the spirit and scope of the invention. It is therefore desired to be limited only by the scope of the appended claims.

I claim:

1. In a timing device, a first timing mechanism including intermittent drive means arranged to drive said first timing mechanism through one cycle and stop after being started, a second timing mechanism constructed and arranged to start said first timing mechanism at predetermined intervals, said second timing mechanism including a spring return timing element and a clutch means, said spring return timing element and clutch means being constructed and arranged to cause the spring return timing element to be driven through a timing cycle when the clutch means is engaged, and to start the first timing mechanism at the end of a period of time, said spring return timing element being constructed and arranged to reset to a starting point when the clutch is disengaged, and cam operated means driven with the first timing mechanism constructed and arranged to actuate said clutch means to first disengage and then reengage said clutch means as the first timing mechanism goes through its cycle.

2. The combination recited in claim 1 in which the clutch means includes a gear bodily carried by a cam follower forming part of the cam operated means, said gear and disengaging a driving gear to provide the clutching function, and strain relief means for preventing binding of said gears.

3. The combination recited in claim 2 in which the strain relief means includes a slotted bearing means for the cam follower and a spring means constructed and arranged to press the cam follower toward one end of the slotted bearing means.

4. The combination recited in claim 3 in which the spring means also biases the cam follower against a cam operated with the first timing mechanism.

5. The combination recited in claim 1 including an adjustable reset stop means for the spring return timing element, said adjustable stop means including an adjusting member having means for retaining it in adjusted position and a stop member movable relatively to the adjusting member, said stop member being engaged by the spring return timing element when it resets, and means including yieldable means for normally holding the stop member in fixed position relative to the adjusting member, said yieldable means being arranged to yield on impact by the spring return timing element.

6. The combination recited in claim 5 in which the spring return timing element, adjusting member and stop member are mounted on a common axis and the yieldable means consists of a torsion spring between the adjusting member and stop member.

7. The combination recited in claim 1 in which the intermittent drive means for the first timing mechanism includes a drive pinion and a gear having a segment without teeth causing the gear to stop when this segment reaches the drive pinion, the second timing mechanism advancing the gear to reengage the pinion, said first timing mechanism including a cam driven by said gear, a switch biased against the cam exerting a resilient force thereon and having a first position and a second position, said cam being formed with a slope engaged by said switch and arranged to advance the cam for gear engagement without transfer of the switch from one position to the other.

8. The combination recited in claim 7 in which the first timing mechanism includes an additional cam and switch, the additional switch also exerting a resilient force on its cam the cams operating said switches in sequence, both cams being formed with slopes engaged by the switches and arranged to advance the gear into engagement with the pinion.

9. In an automatic reset timer, a spring return timing element, drive means including a clutch for driving said element in one direction when the clutch is engaged, said timing element being arranged to reset to a starting position when the clutch is disengaged, adjustable reset stop means for the timing element, said stop means including an adjusting member having means for retaining it in adjusted position and a stop member movable relatively to the adjusting member, said stop member being engaged by the spring return timing element when it resets, and yieldable spring means arranged to normally hold the stop member in fixed relationship with the adjustable member, said spring means serving the dual function of yielding to impact of the timing element on resetting and yielding to movement of the adjusting member when it is moved with the clutch engaged.

10. The combination recited in claim 9 in which the spring return timing element, adjusting member and stop member are mounted on a common axis and the yieldable means consists of a torsion spring between the adjusting member and stop member.

11. In a start stop timer, a first timing mechanism having an intermittent drive means including a drive pinion and a gear having a segment without teeth causing the gear to stop when the segment reaches the drive pinion, means including a second timing mechanism for advancing the gear to reengage the pinion, said first timing mechanism including a cam driven by said gear, a switch biased against the cam exerting a resilient force thereon and having a first position and a second position, said cam being formed with a slop engaged for gear engagement without transfer of the switch from one position to the other.

12. The combination recited in claim 11 in which the first timing mechanism includes an additional cam and switch, the additional switch also exerting a resilient force on its cam, said cams operating said switches in sequence, both cams being formed with slopes engaged by the switches and arranged to advance the gear into engagement with the pinion.

* * * * *